US006032317A

United States Patent [19]

Wiley

[11] Patent Number: 6,032,317

[45] Date of Patent: Mar. 7, 2000

[54] CLEANING DEVICE

[76] Inventor: Jeffrey D. Wiley, P.O. Box 384, Parker, Colo. 80134

[21] Appl. No.: 08/975,147

[22] Filed: Nov. 20, 1997

[51] Int. Cl.[7] ..... A47L 1/06; A47L 13/16

[52] U.S. Cl. ..... 15/220.1; 15/231; 15/393; 15/210.1; 401/201; 401/40; 401/42

[58] Field of Search ..... 15/232, 231, 209.1, 15/210.1, 220.1, 415.1, 393, 244.3, 228; 401/196, 201, 203, 204, 205, 40, 42

[56] References Cited

U.S. PATENT DOCUMENTS

| | | | |
|---|---|---|---|
| 1,151,832 | 8/1915 | Serrell | 401/42 |
| 1,691,024 | 11/1928 | Gedge | 401/205 |
| 1,809,302 | 6/1931 | Lawrence | 15/393 |
| 2,601,689 | 7/1952 | Mallard | 401/205 |
| 2,736,913 | 3/1956 | Mirth | 401/201 |
| 2,873,465 | 2/1959 | Miller | 15/393 |
| 2,916,759 | 12/1959 | Smith | 15/231 |
| 2,956,287 | 10/1960 | Stanford | 131/241 |
| 3,099,855 | 8/1963 | Nash | 15/231 |
| 3,124,828 | 3/1964 | Barber et al. | 401/42 |
| 3,589,819 | 6/1971 | Bryant | 401/42 |
| 3,760,450 | 9/1973 | Griffin et al. | 15/231 |
| 4,976,000 | 12/1990 | Wiley | 15/220.1 |

FOREIGN PATENT DOCUMENTS

| | | | |
|---|---|---|---|
| 781632 | 2/1935 | France | 15/231 |
| 1045163 | 5/1924 | Switzerland | 15/231 |
| 965609 | 8/1964 | United Kingdom | 15/231 |

*Primary Examiner*—Gary K. Graham

[57] ABSTRACT

A device for cleaning surfaces, especially curved or irregular surfaces. The cleaning device includes a base including a generally flat plate possessing a plurality of holes and a conical projection extending away from one side of the plate. The distal end of the conical projection is adapted to receive a longitudinal end of a hollow rod or pole. The device also includes a pillow filled with polystyrene pellets which is glued to the flat base, adjacent to the holes. A cleaning fluid may be delivered under pressure through the hollow rod, into the cavity of the conical projection, and through the holes of the plate to the pillow. Alternatively, a vacuum suction source may be applied to the interior of the hollow rod, whereby liquid in the pillow is sucked through the holes and into the cavity. Alternatively, a generally rectangular cover may selectively surround the pillow, with the corners of the cover being selectively crimped in serrated slits in the peripheral edge of the plate.

8 Claims, 3 Drawing Sheets

CLEANING DEVICE

BACKGROUND OF THE INVENTION

The instant cleaning device constitutes an improvement over the cleaning device described in the inventor's U.S. Pat. No. 4,976,000, the subject matter of which is incorporated herein by reference.

The inventor has gained significant knowledge from manufacturing and marketing the cleaning device described in his '000 patent and has created various ways of improving upon his earlier cleaning device.

The inventor's earlier cleaning device possessed a mushroom shaped pillow that depended into a conical shaped cavity of a base. While the pillow was deformable to accommodate a variety of concave and convex shapes, the pillow was perhaps too easily deformable in a sense that pressure applied by the pillow against a surface to be cleaned would simply further deform the pillow and depress it into the cavity, instead of providing greater frictional force between the pillow and the surface so that the surface could be scrubbed.

The earlier cleaning device also preferably utilized a removable cover including a peripheral elastic band adapted to surround the pillow. It was anticipated that these covers would be removable for washing, but would be also disposable, such that a customer would reorder additional covers. Customers have generally been reluctant to buy a product that needs manufactured replacement parts, and the process of fulfilling customer demand for such covers is fraught with problems.

Also, while the inventor's earlier cleaning device could be dunked in a bucket of cleaning solution (such as water, ammonia, and detergent) and applied to a window or other surface to be cleaned, such a technique was sometimes messy, was awkward if a long extension pole was used, and required frequent dunkings when cleaning relatively large surfaces.

Lastly, the earlier device has been used as a mop to clean surfaces of undesired liquids. If a relatively large amount of liquid were to be mopped, the pillow and cover would become very quickly saturated with water, without a convenient way to quickly squeeze, drain or remove the liquid away from the pillow and cover.

SUMMARY OF THE INVENTION

The present invention relates to a device for cleaning surfaces, especially curved or irregular surfaces. The cleaning device includes a base including a generally flat plate possessing a plurality of holes and a conical projection extending away from one side of the plate. The distal end of the conical projection is adapted to receive a longitudinal end of a hollow rod or pole. The device also includes a pillow filled with polystyrene pellets which is glued to the flat base, adjacent to the holes. A cleaning fluid may be delivered under pressure through the hollow rod, into the cavity of the conical projection, and through the holes of the plate to the pillow. Alternatively, a vacuum suction source may be applied to the interior of the hollow rod, whereby liquid in the pillow is sucked through the holes and into the cavity. Alternatively, a generally rectangular cover may selectively surround the pillow, with the corners of the cover being selectively crimped in serrated slits in the peripheral edge of the plate.

BRIEF DESCRIPTION OF THE DRAWINGS

The present invention will be described with reference to the accompanying drawings, wherein.

BRIEF DESCRIPTION OF A PREFERRED EMBODIMENT

Figure 1:
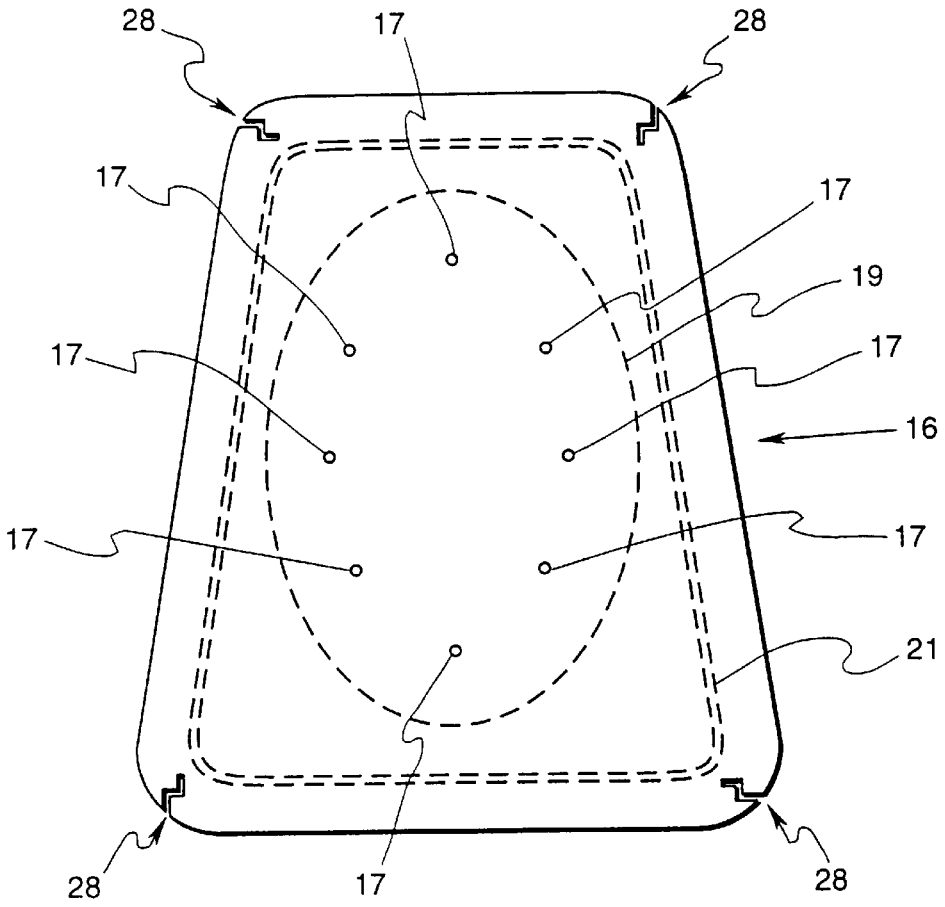
FIG. 1 is a bottom view of the base plate in accordance with one embodiment of the present invention.

The present invention will be described with reference to the accompanying drawings wherein like reference numerals refer to the same item.

Figure 3:
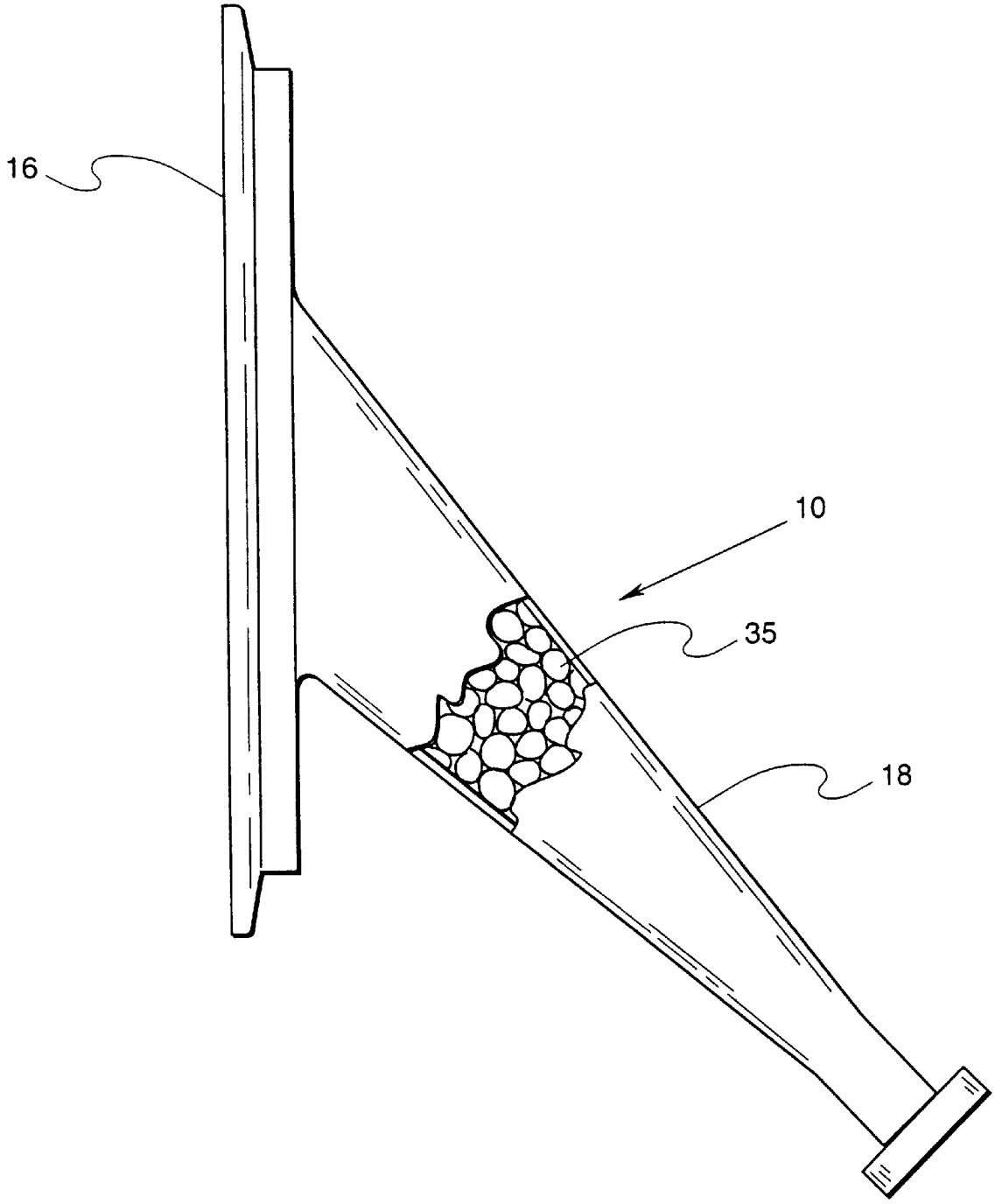
FIG. 3 is a side view of a base in accordance with one embodiment of the present invention having a cut-away view to show pellets of a cleaning substance disposed within the cavity thereof.
Figure 4:
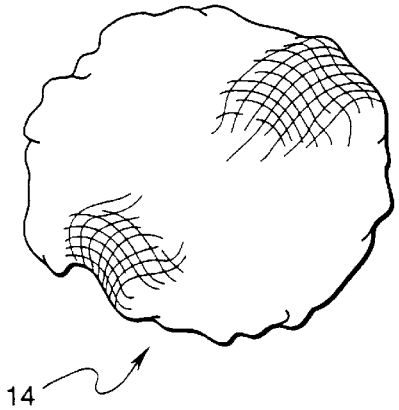
FIG. 4 is a side view of a pillow of the cleaning device.
Figure 5:
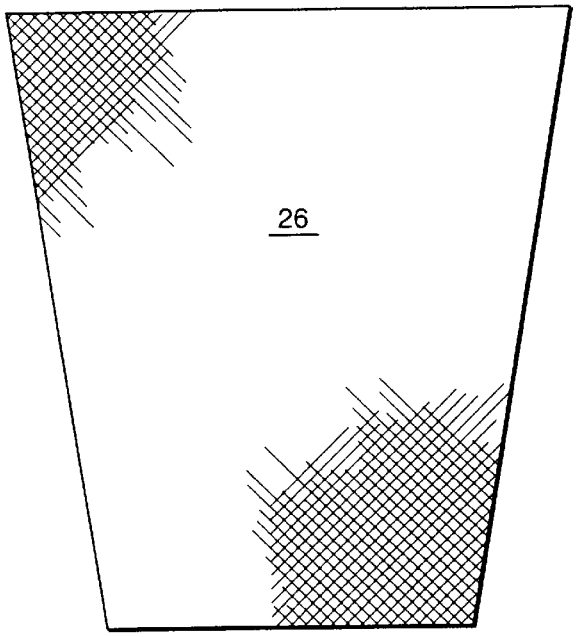
FIG. 5 is a plan view of a substantially rectangular cover used to cover the pillow shown in FIG. 4.
Figure 6:
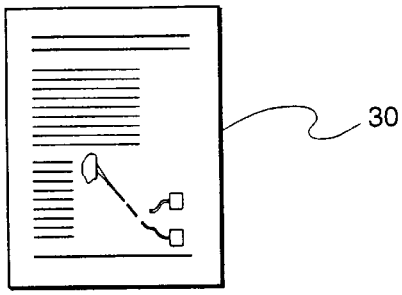
FIG. 6 is a plan illustration of a printed information flyer describing how to create the covering shown in FIG. 5 and how to selectively maintain the covering about the pillow shown in FIG. 4.
Figure 7:
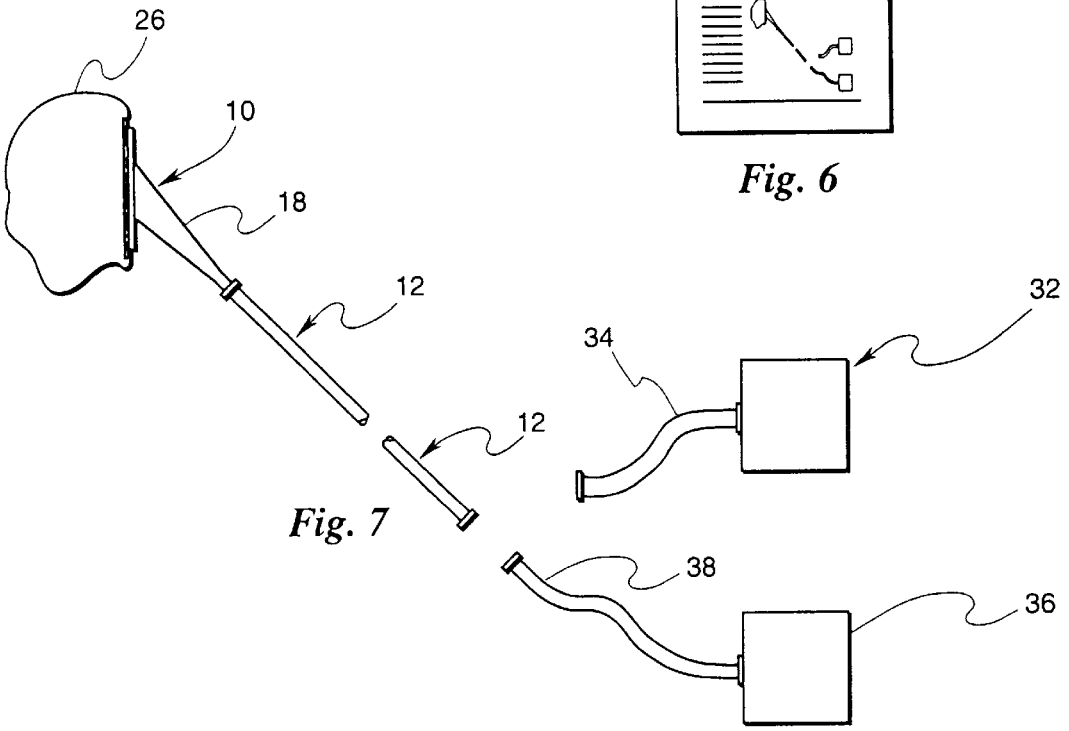
FIG. 7 is a perspective illustration of the cleaning device in accordance with one embodiment of the present invention in which either a cleaning fluid source or a vacuum source may selectively communicate with the pillow shown in FIG. 4.

The cleaning device in accordance of one embodiment of the present invention includes a base 10, a relatively long hollow rod 12, and a pouch or pillow 14, as best shown in FIG. 3, 4 and 7.

The base 10 includes a substanially flat plate 16 and conical profection 18 extending away from one side of the plate 16 at an angle in the range of between thirty to seventy-five degrees, and preferably at an angle of about fifty degrees. The conical profection 18 is hollow and joins the plate 16 as shown by the oval shaped dotted line 19 in FIG. 1. The distal end of the conical projection 18 is adapted to receive the longitudinal end of the rod 12. Preferably the distal end and the rod 12 may be theadably secured to the conical projection 18. The plate 16 also possesses a plurality of holes 17 extending therethrough within the oval region of joinder between the conical projection 18 and the plate 16. Although FIG. 1 shows such holes 17 to number eight and to be arranged in generally oval array, it should be appreciated that a variety of numbers, shapes, sizes, and arrangements of holes 17 may be selected for advantageous use in connection with th invention.

The plate 16 and the conical projection 18 are preferably fashioned of the same material, preferably plastic, and preferably styrene. Thus, the base 10 may be conveniently and relatively inexpensively manufactured in two plastic parts. The plate 16 and the conical projection 18 may be securely, permanently joined by gluing the large end of the conical projection 18 to the plate 16 with a compound such as "Ketone".

The base plate 16 generally possesses a rectangular configuration, and preferably a trapezoidal configuration in which the two opposing, non-parallel sides of the trapezoid converge at equiangular intersections with the two parallel, opposing sides. Such a configuration assists in cleaning cornered surfaces.

The pillow 14 may be fashioned as set forth in the inventor's U.S. Pat. No. 4,976,000, however, the pillow is preferably fashioned in a generally cylindrical or spherical shape, rather than a mushroom shape. The pillow 14 may contain a plurality of polystyrene pellets, as described in the '000 patent.

In the instant invention, the pillow 14, instead of being selectively attached to the plate 16, such as by hook and loop fasteners, is permanently attached to the plate 16 by a glue. A preferred glue is sold under the trademark "Liquid Nails". The glue is applied to the surface of the plate 16, on the side opposite to the conical projection 18, and then the pillow is centered and pressed against the surface of the plate 16. A groove indicated by the dashed lines 21, as showing in FIG. 1, continuously extends along the surface of the plate 16 opposite to the conical projection, parallel to, but spaced from, the peripheral edge of the plate 16. The groove 21 helps to prevent the excessive spreading of the glue and also helps to provide a more secure foothold for the glue against the plate 16.

Because the pillow 14 is secured to the relatively flat plate 16, when the cleaning device is pressed against a surface, with the pillow generally deforming to the contour of the surface, the application of a force on the plate 16 toward the surface to be cleaned causes the pillow 14 to transmit the force against the surface—in contrast to the cleaning device described in the '000 patent in which additional force may cause the pillow to sink further into the cavity of the conical projection.

The cleaning device preferably includes a selectively removable, disposable covering 26, adapted to surround the pillow 14 and adapted to be selectively secured to the plate 16 in a manner to be described. The covering 26 is preferably fashioned of a liquid permeable, liquid absorbent fabric material, such as terry cloth. Preferably, the covering 26 is generally rectangular shaped and very preferably is configured in a trapezoid configuration substantially identical to, but larger than the trapezoid shape of the plate 16.

It will be appreciated that the covering 26 preferably possesses four corners, each of which is selectively secured to the plate 16 through a corresponding number of spaced apart apertures in the plate 16, each of which apertures possesses differently angled segments. As best shown in FIG. 1, the plate 16 possesses four such apertures, 28, each of which apertures 28 comprises a slit extending inwardly from the peripheral corner edge of the plate 16 and possessing a saw tooth or serrated configuration. Each corner of the covering 26 may be twisted or pinched and then pulled through a corresponding one of the apertures 28 whereby the associated corner of the covering 26 is maintained in a crimped condition within the associated aperture 28. The covering 26 may be removed from the cleaning device by simply tugging each corner of the covering 26 until the same is disengaged from its associated aperture 28.

Figure 2:
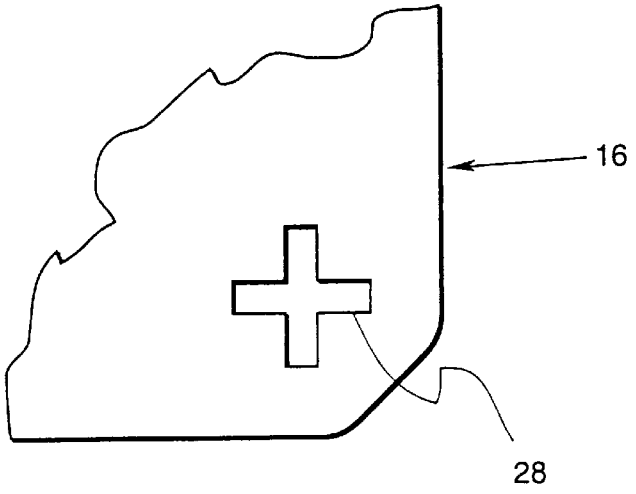
FIG. 2 is a cut-away view of the base plate in FIG. 1 illustrating an alternative structure for securing the corners of a cover through a cross shaped aperture.

In an alternative embodiment of the present invention, as shown in FIG. 2, each of the four apertures 28 may possess a cross shape configuration and may be spacingly disposed adjacent to a corresponding peripheral corner edge of the plate 16. In a like manner, each corner of the covering 26 may be twisted or pinched and then pulled through the cross shape aperture 28 such that the covering 26 is maintained about the pillow 14. In this embodiment also, the covering 26 may be removed from the plate 16 by tugging each corner of the covering 26 back through the associated aperture 28.

It should be appreciated that the covering 26 may be fashioned by a customer or other user of the cleaning device of the present invention and that the customer or user may create a covering 26 by cutting up an old T-shirt, a dish towel, and the like. Accordingly, the present contemplates that the cleaning device will be sold with printed directions 30 instructing a person how to create the covering and how to selectively maintain the covering in a condition surrounding the pillow by crimping the corners of the covering in the apertures 28 of the base 16.

It is also contemplated that a cleaning fluid such as water alone or water with any one of a combination of ammonia, detergents, grease removers, or other cleaning substances may be supplied under pressure from a source 32 through a conduit 34 (such as a garden hose), which is connected by means of a male/female threaded coupling member to the longitudinal end of the hollow rod 12 opposite to the base 10. The cleaning fluid is then delivered under pressure through the interior of the hollow rod 12 into the cavity of the conical projection 18, through the holes 17 in the plate 16 and into the pillow 14 (and if a covering 26 is used, then also through the covering 26). Such a system is shown in FIG. 7. The cleaning fluid may be supplied at a selected pressure and at selected intervals. Also, the composition of the cleaning fluid may be selected for the specific surface to be cleaned. For example, the cleaning device may be used with a specially composed cleaning fluid to clean surfaces such as the stained glass windows of churches, the exterior surface of skylights in residences and office buildings, the interior surfaces of tanks, air ducts in restaurants and other buildings, and the outside surfaces of motor vehicles, such as recreational vehicles.

In another embodiment of the present invention, a cleaning substance such as detergent, may be poured through the distal end of the conical projection 18 for disposition within the cavity thereof. In a preferred embodiment, the cleaning substance may comprise soap fashioned in the form of pellets 35, as best shown in FIG. 3. Preferably the pellets 35 are much larger than the holes 17 in the plate 16. As water or another cleaning fluid passes into the cavity of the conical projection 18 and passes the pellets 35, some of the cleaning substance from the pellets 35 will be carried by the fluid. As the pellets 35 become depleted in size and number through use, the pellets 35 may be replenished. Also, in yet another embodiment of the present invention, the pellets enclosed within the pillow 14 may be impregnated with a cleaning substance, which substance likewise is carried by any fluid passing thereby.

In an alternative embodiment also shown in FIG. 7, the cleaning device of the present invention may be used to clean or mop liquid from a surface, such as condensate on the ceilings of meat processing plants. In this particular embodiment, a vacuum source 36 communicates through a conduit or hose 38, which is threadably coupled through a male/female connection to the longitudinal end of the hollow rod 12 opposite to the base 18. Thus, a suction force is transmitted through the hollow rod 12, through the cavity of the conical projection 18, through the holes 17 of the plate 16, and to the pillow 14 and any associated covering 26. The suction force creates an air flow which helps remove moisture from the pillow 14 and any associated covering 26. The moisture may be collected from the cavity of the conical projection 18, or more preferably, may be removed at the vacuum source 36. It is believed that the preferred vacuum source is sold under the brand name "Shop Vac".

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than as specifically described above.

What is claimed is:

1. A device adapted for cleaning dust, grime and the like from a surface comprising:

a base provided with at least one aperture formed by a serrated slit extending from the peripheral edge of said base;

a plurality of pellets;

a flexible pouch enclosing said pellets in a loose and non-ordered state such that the shape of the peripheral surface of said pouch is deformable;

means for attaching said pouch to the base; and a flexible, removable cover adapted to surround at least a portion of said pouch whereby said cover may be selectively maintained in a condition of surrounding at least a portion of said pouch by extending a portion of said cover through said base aperture such that said cover portion assumes a crimped condition.

2. A cleaning device according to claim 1 wherein said base is provided with four apertures each formed by a serrated slit extending from the peripheral edge of said base and wherein said cover is substantially rectangularly shaped whereby said cover possesses four corner regions and whereby said cover may be selectively maintained in a condition of surrounding at least a portion of said pouch by extending each corner region of said cover through a corresponding one of said apertures such that each corner region assumes a crimped condition.

3. A device adapted for cleaning dust, grime and the like from a surface comprising:

a base provided with at least one aperture formed by a serrated slit extending from a peripheral edge of said base, said slit including differently angled segments;

a flexible, deformable pouch secured to said base; and a flexible, removable cover adapted to surround at least a portion of said pouch whereby said cover may be selectively maintained in a condition of surrounding at least a portion of said pouch by pulling a portion of said cover through said aperture such that said cover portion assumes a crimped condition.

4. A device adapted for cleaning dust, grime and the like from a surface comprising:

a base provided with four apertures, each of said apertures formed by a serrated slit extending from a peripheral edge of said base, each of said slits including differently angled segments;

a flexible, deformable pouch secured to said base; and a flexible, removable substantially rectangular cover possessing four corner regions whereby said cover may be selectively maintained in a condition of surrounding at least a portion of said pouch by pulling a portion of each corner region of said cover through a corresponding one of said apertures such that each corner region of said cover portion assumes a crimped condition.

5. A cleaning device adapted for cleaning dust, grime and the like through a scrubbing action from either a flat, curved, or irregular surface such as windows, skylights, tank interiors, air ducts, and outside surfaces of motor vehicles, said cleaning device comprising:

a base having a plate possessing a substantially planar surface and provided with at least one aperture formed by a serrated slit extending from a peripheral edge of said base, said slit including differently angled segments;

a flexible pillow secured to and adapted to be pressed against said substantially planar surface of said plate, said pillow being deformable to a degree such that the shape of the peripheral surface of said pillow may be modified to assume the shape of said surface to be cleaned against which said pillow is in forceful contact to promote a scrubbing action;

a flexible, removable cover adapted to surround at least a portion of said pillow whereby said cover may be selectively maintained in a condition of surrounding at least a portion of said pillow by extending a portion of said cover through said aperture such that said cover portion assumes a crimped condition.

6. A kit including a cleaning device adapted for cleaning dust, grime and the like from a surface and including printed directions, said cleaning device comprising:

a base provided with at least one aperture formed by a serrated slit extending from a peripheral edge of said base, said slit including differently angled segments;

a flexible, deformable pouch secured to said base;

a flexible, deformable pouch secured to said base;

a flexible, removable cover adapted to surround at least a portion of said pouch whereby said cover may be selectively maintained in the condition of surrounding at least a portion of said pouch by pulling a portion of said cover through said aperture such that said cover portion assumes a crimped condition; and said printed directions informing a person how to create said cover and how to selectively maintain said cover in a condition of surrounding at least a portion of said pouch.

7. A kit including a cleaning device adapted for cleaning dust, grime and the like from a surface and including printed directions, said cleaning device comprising:

a base provided with four apertures, each of said apertures formed by a serrated slit extending from a peripheral edge of said base, each of said slits including differently angled segments;

a flexible, deformable pouch secured to said base;

a flexible, removable substantially rectangularly cover possessing four corner regions whereby said cover may be selectively maintained in a condition of surrounding at least a portion of said pouch by pulling a portion of each corner region of said cover through a corresponding one of said apertures such that each corner region of said cover portion assumes a crimped condition; and said printed directions informing a person how to create said cover and how to selectively maintain said cover in a condition of surrounding at least a portion of said pouch.

8. A kit including a cleaning device adapted for cleaning dust, grime and the like through a scrubbing action from either a flat, curved, or irregular surface such as windows, skylights, tank interiors, air ducts, and outside surfaces of motor vehicles and including printed instructions, said cleaning device comprising:

a base having a plate possessing a substantially planar surface and provided with at least one aperture formed by a serrated slit extending from a peripheral edge of said base, said slit including differently angled segments;

a flexible pillow secured to and adapted to be pressed against said substantially planar surface of said plate, said pillow being deformable to a degree such that the shape of the peripheral surface of said pillow may be modified to assume the shape of said surface to be cleaned against which said pillow is in forceful contact to promote a scrubbing action;

a flexible, removable cover adapted to surround at least a portion of said pillow whereby said cover may be selectively maintained in a condition of surrounding at least a portion of said pillow by extending a portion of said cover through said aperture such that said cover portion assumes a crimped condition; and said printed directions informing a person how to create said cover and how to selectively maintain said cover in a condition of surrounding at least a portion of said pouch.

* * * * *